US005285625A

United States Patent [19]

Ofrat et al.

[11] Patent Number: 5,285,625

[45] Date of Patent: Feb. 15, 1994

[54] SPIRAL DIAMOND CUT JEWELRY CHAIN

[75] Inventors: Aviad Ofrat, Franklin Lakes; Eitan Weinberg, Fairlawn, both of N.J.; Arie Gur, New York, N.Y.

[73] Assignee: G.O.V. Jewelry, Inc., Manhattan

[21] Appl. No.: 914,846

[22] Filed: Jul. 15, 1992

[51] Int. Cl.[5] ..... B21L 5/02

[52] U.S. Cl. ..... 59/80; 59/3; 59/35.1

[58] Field of Search ..... 59/3, 80, 82, 35.1

[56] References Cited

U.S. PATENT DOCUMENTS

| | | | |
|---|---|---|---|
| D. 301,698 | 6/1989 | Markovits | D11/13 |
| D. 326,065 | 5/1992 | Borgogni | D11/13 |
| 2,424,924 | 7/1947 | Chernow | 59/80 |
| 2,711,069 | 6/1955 | Armbrust | 59/35.1 |
| 4,996,835 | 3/1991 | Rozenwasser | 59/3 |
| 5,129,220 | 7/1992 | Strobel | 59/3 |
| 5,185,995 | 2/1993 | Dal Monte | 59/83 |

FOREIGN PATENT DOCUMENTS

| | | | |
|---|---|---|---|
| 3533637 | 5/1986 | Fed. Rep. of Germany | 59/80 |

OTHER PUBLICATIONS

Sharrah Designs, Inc., Oct. 1989, p. 171, Jeweler's Circular-Keystone.

Sharrah Designs, Inc., Fall Supplement 1990.

*Primary Examiner*—David Jones

*Attorney, Agent, or Firm*—Ostrolenk, Faber, Gerb & Soffen

[57] ABSTRACT

A rope chain formed with "diamond cut" facets which extend spirally around the longitudinal center of the chain. The chain can be formed of solid or hollow links, or of non-standard links not having a circular cross-section.

23 Claims, 6 Drawing Sheets

FIG. 8B
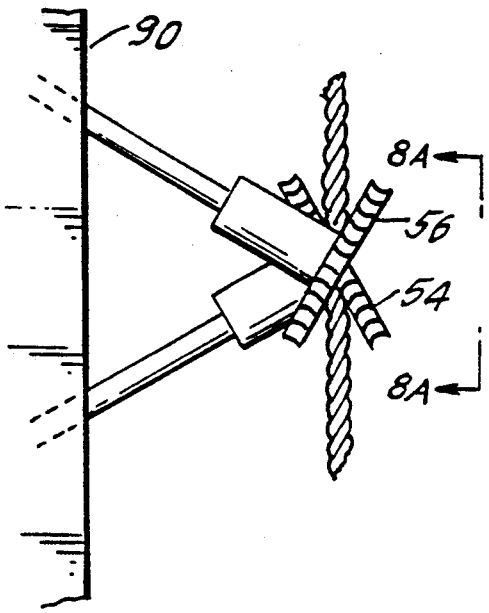
FIG. 8A.
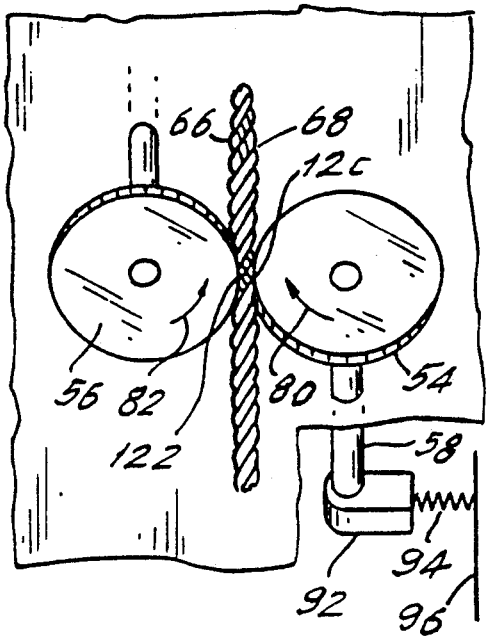
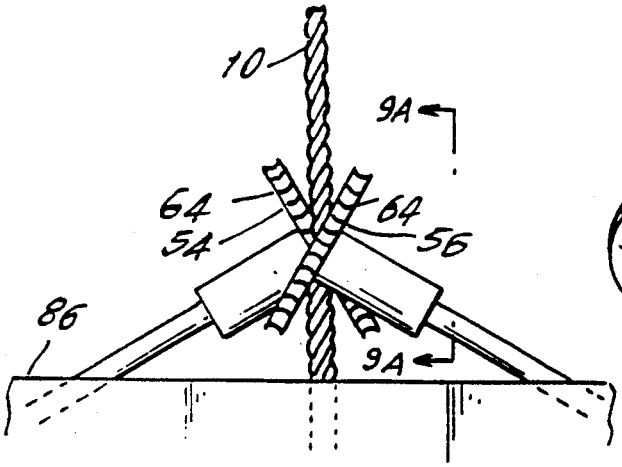
FIG. 9B.
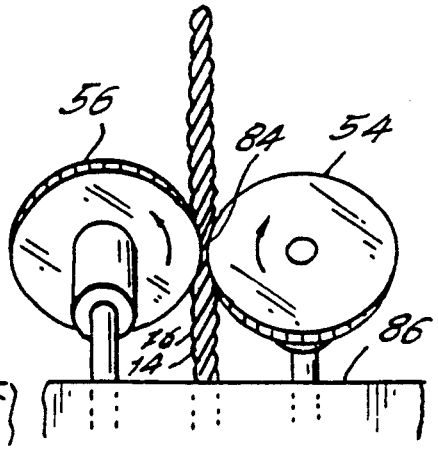
FIG. 9A.

FIG. 11A.
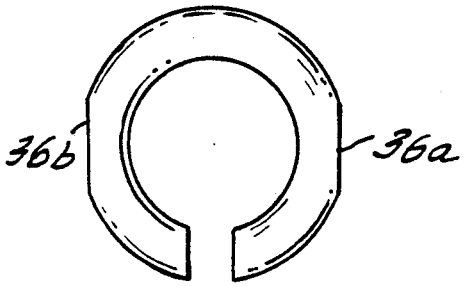
FIG. 11B.
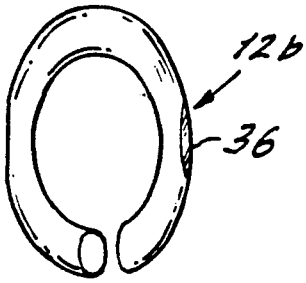
FIG. 11C.
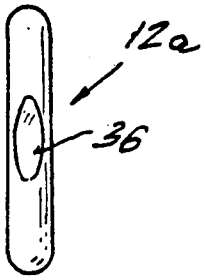
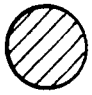
FIG. 13A.
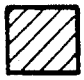
FIG. 13B.
FIG. 12.
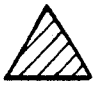
FIG. 13C.
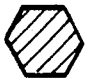
FIG. 13D.
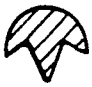
FIG. 13E.
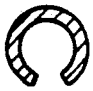
FIG. 13F.
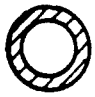
FIG. 13G.
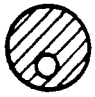
FIG. 13H.
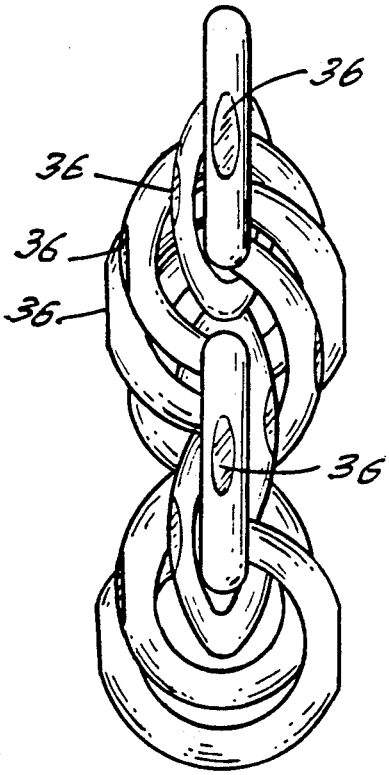

SPIRAL DIAMOND CUT JEWELRY CHAIN

BACKGROUND OF THE INVENTION

The present invention relates to jewelry chains, specifically rope chains, and more particularly relates to a variation on an existing type of chain that is known as a "diamond cut rope chain".

A rope chain is a chain in the form of a rope constituted by a helical series of open rings or links that are interlinked with one another to define a configuration similar to a continuous double-stranded rope. Rope chains made of solid rings are simply known as rope chains while those made of hollow rings or links are known as "hollow rope chains".

The present invention is directed specifically to a type of rope chain to be known as a "spiral diamond cut rope chain" which derives from but provides a new look which differs from the conventional "diamond cut rope chain", to be discussed further on.

Methods for fabricating rope chains and machines therefor are known in the prior art as exemplified by the present inventors' U.S. Pat. No. 5,115,959, the contents of which are incorporated by reference herein. A thorough discussion of the conventional "diamond cut rope chain" is provided in U.S. Pat. No. 5,125,225, the contents of which are similarly incorporated by reference herein.

Prior machines of the general character indicated are described in U.S. Pat. Nos. 4,127,987 (Tega et al); 4,311,901 (Tega); and 4,503,664 (Allazzetta et al). Allazzetta et al is specifically directed to a machine by which the fabrication of rope chain is automated.

Additional patents dealing with the general subject matter include U.S. Pat. No. 4,716,750 of Tizzi, which discloses a machine for producing hollow articles with various tubular cross-sections. U.S. Pat. Nos. 2,424,924 and 2,711,069 describe methods of producing ornamental facets on solid wire chain links through grinding operations. U.S. Pat. Nos. 3,083,002 and 4,268,946 disclose the use of solidifying material such as ice, as a chuck to hold jewelry pieces in place while being worked on.

Further patents directed to the general subject matter include U.S. Pat. Nos. 2,895,290; 3,410,085; 4,679,391; 4,682,467; 4,681,664; 4,996,835; and German patent No. 2,428,642.

As previously noted, the present invention specifically concerns itself with the idea of providing a variation on the conventional diamond cut rope chain and to the construction and methods of fabricating the same.

As can be appreciated from the 5,125,225 patent, a "diamond cut" rope chain is a type of a chain in which the links of the chain are given a quality of sparkle by cutting or shearing away flat facets from the curved solid annular toroidal links, leaving flat surfaces for light to reflect therefrom. Diamond cutting of rope chains made of solid links is accomplished with a deep cut being used, so that from the generally round rope chain a four-faceted square or a six-faceted hexagon cross-section results. This way the "diamond cut" flat surfaces created in the solid chain gives an enhanced sparkling look to the chain.

In the 5,125,225 patent, the difficulty of forming a diamond cut rope chain of other than rope chains made of solid links is discussed. For example, it is noted that to achieve a square or hexagon cross-section chain, the depth of the cut has to be greater than the wall thickness of the annular, i.e. hollow, rings of which a hollow rope chain is made.

As recognized in the 5,125,225 patent (see the paragraph bridging columns 4 and 5 thereof), the prior art was familiar with various machinery and methods for creating hollow articles with various tubular cross-sections. The prior art was further familiar with various techniques of holding a pre-assembled chain in place by such methods as using a solidifying material, i.e. ice, as a chuck to hold the jewelry workpieces. Also noted is the familiarity of the art with stamping impressions into solid chain links and certain techniques for reinforcing hollow thin walled jewelry articles by electroforming. The 5,125,225 patent further recognizes and acknowledges the known use of both solid or hollow links in rope chains.

In view of the known teachings of the prior art, the 5,125,225 patent is specifically directed to a method for incrementally deforming curved hollow links to produce flattened faceted surfaces thereon. The subject patent is exclusively directed to the method involving the application of incremental pressure upon the curved wall surface of an otherwise fully assembled rope chain, thereby deforming the curved outer wall inward until a flattened "faceted" surface appears, similar to the faceted surfaces obtained by shearing/cutting rope chains formed of solid links. By carefully controlling the process of incremental deformations of the chain surfaces, a flat surface appearance which simulate the sheared or cut facet is obtained. It is also claimed that the deformed links of the chain have an increased resistance to fracture of the thin hollow link walls.

It is important to note that the process of the 5,125,225 patent is limited to creating a conventional "diamond cut" rope chain. In other words, as can be appreciated from a mere inspection of FIG. 11 of the subject patent, the burnishing tool used for creating the faceted surfaces is positioned to incrementally deform the chain while the chain is wound on a rotatable lathe. Completing one run of the burnishing tool over the length of the chain results in the formation of only a single facet (more precisely, a single line of sub-facets) on the chain. Since the typical diamond cut rope chain has a plurality of facets which are circumferentially spaced from one another, the chain has to be removed from the lathe and angularly rotated, for example, by 90° three more times to create additional facets to produce a square shaped diamond cut rope chain. A smaller angular spacing is used if the number of facets is to be greater than four, etc.

It is obvious to one who appreciates the process of forming a conventional diamond cut rope chain that it is impossible to, for example, preform the individual links with deformed, flattened surfaces or to otherwise decorate the link surfaces to obtain a "conventional" diamond cut. This is because the conventional rope chain has a shape as shown in FIG. 8 of the subject 5,125,225 patent. Since the diamond cut requires that the surface be sheared to a certain depth relative to the longitudinal center of the chain, it will be immediately apparent that the individual links are not equally sheared or deformed. Rather, those links which are positioned more radially outwardly along the path of the faceted surface will be sheared or deformed to a greater extent than other links in the chain.

Since the links are differently sheared or deformed, it is impossible to preform them and later assemble them into a completed rope chain having the "conventional" diamond cut.

Further, while it might appear from the 5,125,225 patent that it is a straightforward matter to deform the hollow links of the rope chain with the help of a burnishing tool, it is perceived by the inventors herein that in practice the process may be far from simple. This is because it is essential that the chain be precisely placed on the lathe as shown in FIG. 11. If the links should not be perfectly aligned, it is possible that the burnishing tool will not engage and smoothly travel along the circumferential surfaces of the individual links. In such a case, the individual links might tear or be otherwise damaged.

SUMMARY OF THE INVENTION

The inventors herein have perceived that a sparkling and interesting rope chain look providing shining links in a rope chain are possible without producing the conventional diamond cut in which, as noted, a plurality of facets are produced on the chain, where each facet extends substantially along a straight line extending along the longitudinal direction of the chain.

Specifically, it is a main object of the present invention to provide a novel rope chain having flattened or otherwise decorated surfaces preferably with a high reflectivity and a shine which is to be known as a "spiral diamond cut" rope chain.

In the "spiral diamond cut" rope chain of the present invention, "diamond cut" facets are formed on the links in a manner such that the path of faceting imparted to the chain extends spirally around it.

This is accomplished by faceting each of the individual links at one or more locations thereon. The faceting may be in any desired shape including flat, curved, round, etc. The individual links may have any finish including bright or matt and any combination of colors.

The links may be solid, hollow or of cross-sectional shapes other than the conventional circular cross-section. The links may have imparted to them the diamond cut faceting before or after being assembled together to form the completed chain.

The present invention is further directed to a method of forming the diamond cut faceting in the individual links of an already assembled rope chain.

Other features and advantages of the present invention will become apparent from the following description of the invention which refers to the accompanying drawings.

BRIEF DESCRIPTION, OF THE DRAWINGS

Figure 3:
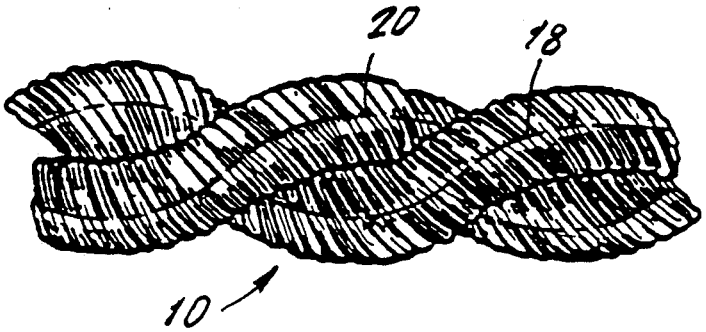
FIG. 3. PRIOR ART
Figure 4:
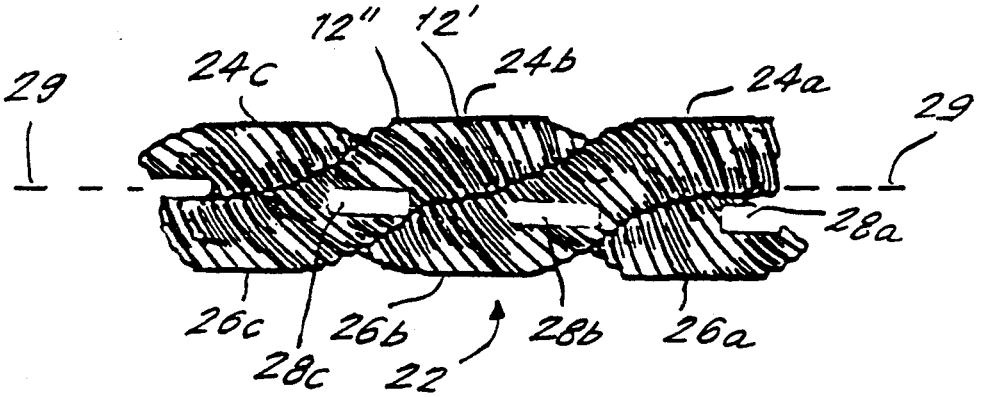
FIG. 4. PRIOR ART
Figure 5:
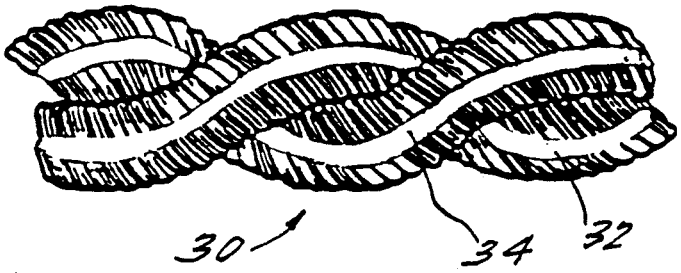
Figure 6A:
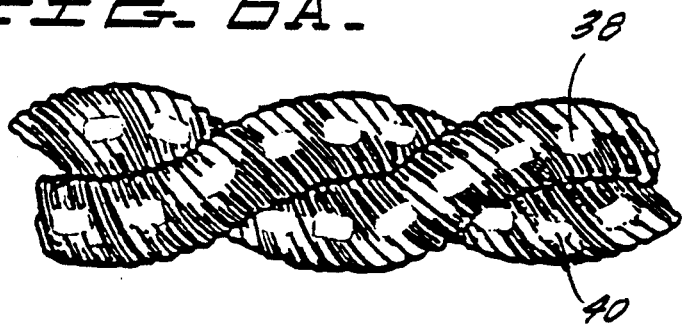
Figure 6B:
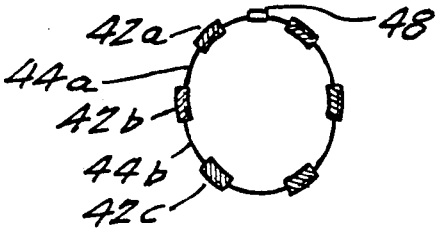
Figure 6C:
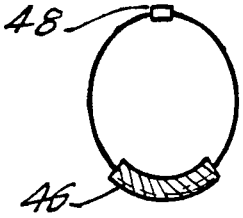
Figure 7:
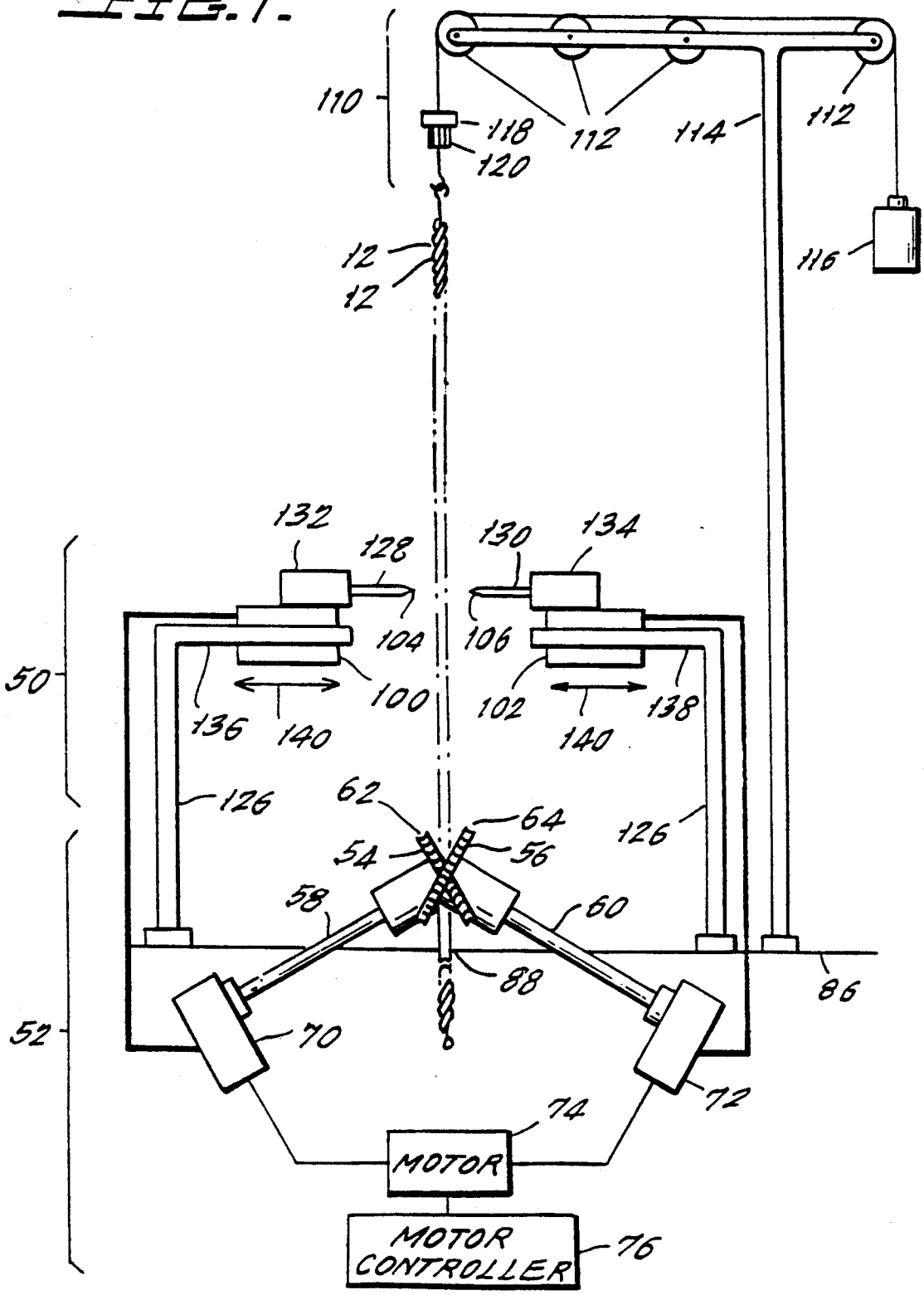
Figure 10:
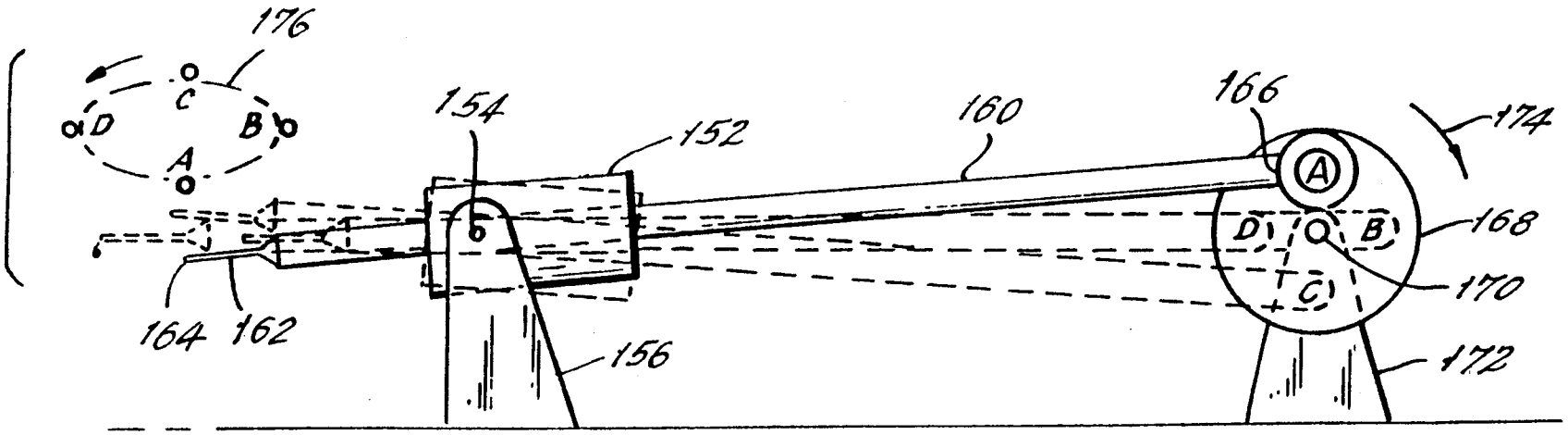

FIG. 3 diagrammatically illustrates a property of a conventional rope chain;

FIG. 4 shows an assembled rope chain which has been faceted to provide it with the conventional "diamond cut" look;

FIG. 5 shows a rope chain with a spiral diamond cut in accordance with the present invention;

FIG. 6A shows a variation of the spiral diamond cut of FIG. 5;

FIG. 6B diagrammatically illustrates one form of a rope chain;

FIG. 6C diagrammatically illustrates another form of a rope chain;

FIG. 7 schematically illustrates a machine designed for tightly holding and incrementally advancing a rope chain and for treating its individual links to impart to them the spiral diamond cut look;

FIGS. 8A, 8B, 9A and 9B depict gear pairs associated with the machine of FIG. 7 which gears are designed to tightly grip and advance the rope chain;

FIG. 10 depicts a variant embodiment of a burnishing or shearing tool usable with the machine of FIG. 7;

FIGS. 11A, 11B and 11C show a chain link disposed respectively at an angle of 0°, 45° and 90° relative to the plane of the paper, to be used for fabricating a spiral diamond cut rope chain therewith;

FIG. 12 illustrates a rope chain which has been spirally diamond cut in accordance with the present invention with its links shown separate from one another to better appreciate the concept of the present invention; and FIGS. 13A–13H show cross-sectional shapes of wire used for fabricating rope chains in accordance with a further concept of the present invention.

DETAILED DESCRIPTION OF THE INVENTION

Figure 1:
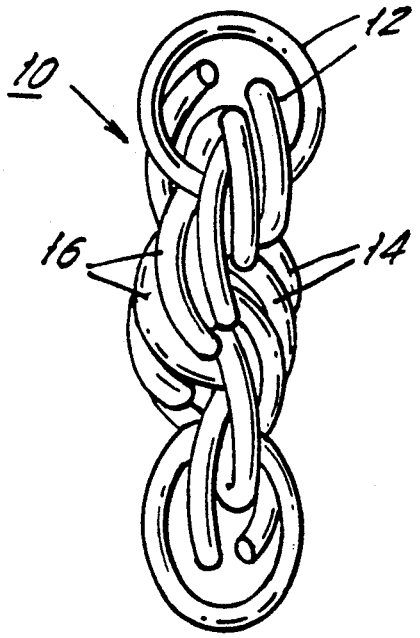
FIG. 1. PRIOR ART
FIG. 1 shows the links of a rope chain intertwined with one another but not yet tightly packed and soldered to one another as in a fully assembled rope chain.
Figure 2:
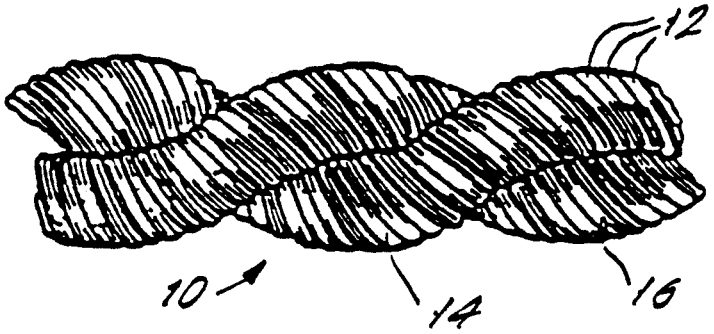
FIG. 2 PRIOR ART
FIG. 2 shows an assembled plain rope chain.

With reference to the drawings, FIG. 1 illustrates a pre-assembled, unsoldered rope chain 10 constituted by a helical series of open rings or links 12 in which adjacent rings are interlinked to define a configuration similar to a continuous double-stranded rope. More specifically, it is comprised of a first, continuous strand of links 14 intertwisted with the second continuous strand 16 (FIG. 2). The rope chain 10 is pre-assembled, either manually or automatically, by forming, feeding, and interlinking the rings 12 and maintaining the shape thereof by reinforcing wires (not shown) which are threaded through it. Thereafter, the open rings are soldered to one another and the reinforcing wires are removed, enabling the chain 10 to have its characteristic rope chain shape shown in FIG. 2.

Figure 1A:
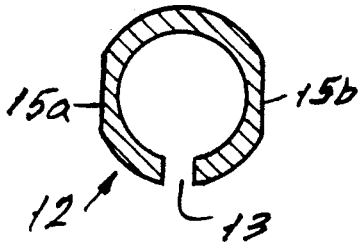
FIG. 1A shows a single link of the rope chain.

With reference to FIGS. 1A and 2, it is noted here that the individual rings 12 inherently assume a predetermined orientation in the chain 10 which orientation is referenced to the link gap 13. Thus, for example, the sides 15*a* and 15*b* of the rings 12 will always lie or follow along one or the other of the notional trace lines 18 and 20 (FIG. 3). Appreciation of the foregoing will facilitate understanding of why a spiral diamond cut rope chain may be fabricated of preformed, i.e. prefaceted, links.

FIG. 4 shows a conventional "diamond cut" rope chain 22. Note that as compared to the rope chain of FIG. 2 which has not been "diamond cut", the rope chain 22 has portions 24*a*–24*c*; 26*a*–26*c*; and 28*a*–28*c* thereof which have been shaved off. Each contiguous portion, e.g. 24*b*, defines a "sub-facet". One straight line of sub-facets defines a "facet". Note that the facets 24*a* to 24*c* extend longitudinally along the chain 22, in a single plane that extends parallel to the longitudinal center 29 of the chain 22.

The amount of chain that has been shaved off can be measured relative to the longitudinal center line 29 of the diamond cut chain 22. It is inherent in the "diamond cut" process that certain ones of the links 12 are shaved to a greater degree than other links. Note, for example, the link 12′ which is more deeply sheared than the link 12″. The prior art chain 22 of FIG. 4 been shown with a diamond cut which yields a square-shaped cross-section indicating that the facets 24, 28, 26 are circumferentially spaced 90° apart around the chain 22 as shown.

It is inherent in the prior art "diamond cut" chains that the chain will lie flat on a horizontal flat surface at each circumferential position where a "facet", i.e., a face has been formed. In contrast, a conventional rope chain that has not been "faceted" i.e., diamond cut, rolls on a flat horizontal surface. Another way of looking at prior art diamond cut rope chains is to note (as seen in prior art FIG. 4) that the sub-facets of successively located links lie in the same plane. For example, the sub-facets of the links at reference numerals 24*a*, 24*b* or 24*c* are all coplanar. This is not true of a chain formed in accordance with the teachings of the present invention. The sub-facet plane of each link is spatially slightly offset from the corresponding sub-facet plane of the preceding and succeeding link. See FIG. 12, and compare the planes to the plane of the paper on which FIG. 12 is drawn. It is apparent that the sub-facet planes of successive ones of the sub-facet 36 are not coplanar.

Turning to the instant invention (see FIG. 5), the "spiral diamond cut" rope chain 30 of the present invention differs from the prior art rope chain 22 essentially in that facets 32 and 34 created in the rope chain 30 extend spirally around it. Note that the facets 32 and 34 represent the unified look obtained when the chain 30 in FIG. 5 is comprised of individual links each having a sub-facet 36 (FIG. 11C) formed thereof. As shown in FIG. 11A, each link can have formed thereon two spaced apart deformations 36*a* and 36*b* yielding spirally extending facets.

The appearance is that of two continuous facets 32 and 34 which are intertwined yielding a double helix. Solely for explanation purposes, one can easily imagine a "ring plane" defined as the plane in which the ring is located. Thus, the ring plane of FIG. 11A lies in the paper, whereas the "ring plane" of the ring in FIG. 11C lies perpendicular to the paper. It is inherent in rope chains that the ring planes of successively located rings revolve about the longitudinal center of the chain. Hence, in contrast to the prior art rope chains, the successive "sub-facets" of the "spiral diamond cut" of the present invention lie in successive planes which revolve about the notional longitudinal center of the chain. The spiral diamond cut rope chain of the present invention has not straight, longitudinally extending "facets" formed as in the prior art rope chains (see definition above) on which the chain could lie flat on a horizontal surface.

In accordance with the concept of FIG. 6A, not all the links 12 are treated to have the "diamond cut". Rather, on an alternating basis, some of the links are treated and others are not, providing an interrupted sequence of spiral diamond cut facets 38 and 40 intertwisted together.

In accordance with other variations of the present invention, only selected portions 42*a*, 42*b*, 42*c* (FIG. 6B) are formed with the spiral diamond cut and other portions 44*a*, 44*b* are not. As another alternative (FIG. 6C), only the center bottom portion 46 of the chain has the diamond cut formed therein. Reference numeral 48 in FIGS. 6B and 6C denote the clasp of the chain.

FIGS. 11A to 11C show the same link sequentially disposed at 0°, 45° and 90° relative to the paper on which the link is drawn. FIG. 12 shows a portion of a chain constructed of the links 12*a* of FIG. 11C.

In accordance with the concept of the present invention, the links 12 can be constructed of hollow or solid wire. In the case of hollow wire, each link made of the hollow wire can be individually pre-deformed, i.e. faceted, prior to being assembled in the rope chain or it can be deformed thereafter in accordance with a method of the present invention, to be described.

The inventors herein further contemplate forming the individual links 12 with various non-standard cross-sections, examples of which are shown in FIGS. 13B to 13H. Thus, the links may have any of the cross-sectional shapes which include a square-shaped cross-section (FIG. 13B); a triangular cross-section (FIG. 13C); hexagonal section (FIG. 13D); mushroom shaped section (FIG. 13E); horseshoe shaped section (FIG. 13F); thick walled hollow cross-section (FIG. 13G); and off-center hollow cross-section (FIG. 14H).

The concept of the present invention is applicable to, and "rope chain" as used herein shall denote any type of chain including hollow, solid, fine rope (U.S. Pat. Nos. 4,996,835 and 4,934,135), jewelry rope (U.S. Pat. No. 4,651,517), Singapore chain, and rose chain (Design Pat. No. 301,699).

As already noted, it is contemplated the cuts or deformations or patterns on the individual links 12 can be formed on one side or two sides of the links 12. The chain may be formed with every link having formed thereon the diamond cut. Alternatively, the chain may be formed with only every second, third, fourth, etc. ring having the subject cut. Also, there may be one cut or a plurality of deformations on each link. These deformations may be formed in any desired shape including straight, curved, round, etc.

The individual links may have any finish including bright or matt, and the chains may be formed in any combination of colors.

The present invention is further directed to the method of forming a chain having a "spiral" diamond cut. In accordance with the present invention, the individual links or rings 12 may be formed with the deformations made prior to the rings being assembled into a completed chain. Such rings can be individually shaved or sheared in the case of solid rings, or deformed in the case of hollow rings. Or, the rings can be premolded or cast to give them the particular shape. For example, hollow rings can be premolded or cast to have the desired shape mentioned above.

Alternatively, the rope chain may be first assembled and thereafter processed with a machine similar to the one disclosed in the aforementioned U.S. Pat. No. 5,115,959, by which machine the rings may be tightly held for a process which, instead of applying solder to the individual links, forms in them the individual deformation needed to create the spiral diamond cut.

Specifically, with reference to FIG. 7, a diamond cut forming mechanism 50 which serves to apply or form the diamond cut on the individual links 12 is used in conjunction with a rope chain feeding mechanism 52. The rope chain feeding mechanism 52 comprises a pair of gears 54 and 56 supported on and rotatable by respective shafts 58 and 60. The gears 54 and 56 are positioned relative to one another in a manner that enables the gears to hold between them the rope chain 10 tightly as shown in FIGS. 8A or 9A.

To enable precise feeding and positioning of successively located links 12*c* and 12*d* (FIG. 8A) of the rope chain 10 relative to the diamond cut forming mechanism 50, the peripheral surfaces of the gears 54 and 56 have been shaped to provide a trench 62 in which gear teeth 64 are formed. The size and shape of the trench 62 conforms to the corresponding shape of the strands 14 and 16 of the rope chain 10. Further, the spatial orientation of the shafts 58 and 60, and hence of the trenches 62, is such that the strands 14 and 16 fit snugly in the trenches 62, the gear teeth 64 registering with the link junctions 66, 68, etc (FIG. 8A).

Each of the gears 54 and 56 is rotated by a respective one of gear boxes 70 and 72 which are in turn driven by a motor 74 under the control of a motor controller 76. The motor controller 76 energizes the motor 74 in discrete sequential steps. This sequentially rotates the gears 54 and 56 and serves to rotate and advance the rope chain 10 by the equivalent of one rope chain link 12, corresponding to the advancement of the gear teeth 64 by one gear tooth.

As can best be appreciated from FIG. 8A, the gear 54 engages the first strand 14 of the rope chain 10 with its teeth gear 64 interengaged and registered with the link junctions 66, 68, etc. thereof. The gear 56, on the one hand, engages the second strand 16 with its teeth gear 64 similarly registering with the link junctions thereof.

As a result, when the gears 54 and 56 are rotated in the direction of their respective arrows 80 and 82 by the equivalent of a one gear tooth movement, the link junctions are sequentially positioned, one after another, at a predetermined holding position 84 (FIG. 9A) which, as will be seen, enables the forming mechanism 50 to create in the links then located at the holding position 84 the necessary deformation for a "diamond cut". The action may involve shearing the surface of the links or deforming a wall portion thereof, etc.

It will be appreciated that, since the rope chain 10 is constituted of the twisted pair of continuous strands 14 and 16, as the gears 54 and 56 rotate the rope chain 10 is slowly rotated while simultaneously being advanced through the action of gears 54 and 56.

The feeding mechanism 52 for the rope chain 10 shown in FIG. 7 corresponds to the embodiment of FIGS. 9A and 9B in which the shafts 58 and 56 for the gears 54 and 56 are supported at the horizontally disposed platform 86. The rope chain 10 is fed through an opening 88 in the platform 86 from a bin (not shown) from which it is fed to a position above the platform 86.

FIGS. 8A and 8B illustrate an alternate embodiment wherein the shafts 58 and 60 of the gears 54 and 56 are supported in a vertically disposed wall 90. Operationally, both embodiments provide the same function, except possibly that in the FIGS. 8A and 8B embodiment a less cluttered platform 86 is provided.

It is desirable that the gears 54 and 56 be resiliently biased toward one another. This enables the gears 54 and 56 to press on and firmly hold the rope chain 10 with a desired, predetermined pressure. To this end and as shown by FIG. 8A, the shaft 58 of the gear 54 may have affixed to it a block 92 which is biased by a spring 94 that is itself anchored against a fixed brace 96. The gear 54 is thus resiliently urged toward the gear 56 by the spring 94. A similar arrangement is also provided for the embodiment of FIGS. 9A and 9B (not shown).

After each stepped advancement of the rope chain, first and second diamond cut forming tools 100 and 102 are moved laterally to apply a controlled, deforming or shearing force to the rope chain 10, on diametrically opposed sides thereof and precisely on the individual links **12*c* and 12*d* (FIG. 8A) that are in that instant at the holding position 84 adjacent the tools 100 and 102**.

For ease of presentation, the forming tools 100 and 102 have been drawn in FIG. 7 at an exaggerated distance away from the gears 54 and 56. In actuality, these tools 100 and 102 are preferably oriented at a 90° angle relative to the plane of the figure, whereby their respective tips 104 and 106 are able to contact the rope chain at forming positions which are located at or very near the point where the chain is engaged and tightly held between the gears 54 and 56.

As should be evident from the foregoing, the motor controller may be configured such that the burnishing or shearing force applied by the tools is not applied at every gear or chain position and that some links are skipped, as desired.

The rope chain pulling system 110 comprises pulleys 112, a support 114, a weight 116, and a coupling 118. The lower portion 120 of the coupling 118 is rotatable relative to its upper portion enabling the system 110 to pull the rope chain and maintain it taut while it is being slowly rotated by the feeding mechanism 52.

FIG. 7 schematically illustrates the concept of the diamond cut forming system 50 and shows a pair of L-shaped brackets 126 which are secured at one end thereof to the platform 86. The needles 128 and 130 have tips 104 and 106 for forming the diamond cut. The needles 128 and 130 are coupled to blocks 132 a nd 134 which are mounted to respectively move with the tools 100 and 102 which slide on the short arms 136 and 138 in the direction indicated by the arrows 140.

FIG. 10 illustrates a variant embodiment of the forming tools 100 or 102. Thus, a "diamond cut" forming tool 150 may be constructed to include a shell 152 pivotally supported by a laterally extending hinge pin 154 in a stand 156. The shell 152 has an axially extending bore 158 for a rod 160 reciprocally movable within the axial bore 158. The rod 160 terminates in a needle 162 having a carving or burnishing tip 164.

At its other end 166, the rod 160 is pivotally connected to a pulley 168, at a position on the pulley 168 eccentric to a pin 170 about which the pulley 168 is rotatably supported on the support 172. As the pulley 168 rotates in the direction of the arrow 174 (through a motive power provided either from the gear box 70, 72 via a coupling or belt (not shown), or through its own source of motive power), the rod 160 reciprocates in a manner whereby the needle tip 164 traverses the elliptical path 176, going through points A, B, C, D corresponding to the positions A, B, C, D of the pulley 168.

In operation, as the pulley 168 is rotated (in synchronism with the gears 54, 56) the elliptical path 176 of the tool tip 164 may be advantageously deployed to shear or burnish the individual links of the chain as desired. Of course, the needle 162 might be bent into shapes different than that shown in FIG. 10, the pulley rotated in the opposite direction, or other measures may be provided to cause the tip 164 to wipe against the links to burnish or shear them to obtained desired effects.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A jewelry chain, comprising:

a plurality of links intertwined with one another and forming a chain which extend along a longitudinal direction and which defines a notional longitudinal chain center, at least one facet extending spirally around said longitudinal center of said chain along the length thereof, said at least one facet being defined by sub-facets imparted to successively located ones of said links, successive ones of said sub-facets lying in different spatially oriented planes.

2. The chain of claim 1, wherein said chain is a rope chain.

3. The chain of claim 2, wherein said faceting is formed on said selected ones of said links at a predetermined location thereon.

4. The chain of claim 1, wherein the faceting is formed on a first predetermined number of sequentially located links and is not formed on a second predetermined number of sequentially following links and so on along the length of the chain.

5. The chain of claim 1, wherein only a portion of the chain is faceted to create therein a spiral diamond cut.

6. The chain of claim 1, wherein said links are made of a solid wire.

7. The chain of claim 1, wherein said links are made of a hollow wire.

8. The chain of claim 1, wherein the links have a non-circular and a non-tubular cross-section.

9. The chain of claim 1, wherein said links having said faceting thereon contain more than one sub-facet.

10. The chain of claim 1, wherein said chain is a fine rope chain.

11. The chain of claim 1, wherein said chain is a jewelry rope chain.

12. The chain of claim 1, wherein said chain is a rose rope chain.

13. The chain of claim 1, wherein the faceted surface is constituted of a series of flat sub-facets.

14. The chain of claim 1, wherein the faceted surface is constituted of a series of curved sub-facets, each said curved sub-facet lying substantially in a respective one of said different planes.

15. Process of fabricating a spiral diamond cut chain, comprising:

providing a plurality of links;

assembling the links together to form a chain; and creating a sub-facet on said links, the chain being assembled to have at least one series of sub-facets, the series of sub-facets defining a spiral diamond cut facet which extends spirally about a longitudinal center of the chain, successive ones of the sub-facets lying in successive different spatially oriented planes.

16. The process of claim 15, including first forming the sub-facets on the links and thereafter assembling the links into the chain.

17. The process of claim 15, including molding the links to form the sub-facets thereon.

18. The process of claim 15, wherein the links are hollow and including deforming the surface of the links to create the sub-facets thereon.

19. The process of claim 18, including carrying out said deforming prior to assembling said links into said chain.

20. The process of claim 18, including carrying out said deforming after assembling said links into said chain.

21. The process of claim 15, wherein each of the links has a reference point and each said sub-facet is created at a predetermined location relative to said reference point.

22. The process of claim 15, wherein a plurality of spaced facetings are applied at predetermined locations on the links.

23. The process of claim 15, wherein each of the links has a cross-sectional shape other than circular.

* * * * *